US009045936B2

(12) United States Patent
Cho

(10) Patent No.: US 9,045,936 B2
(45) Date of Patent: Jun. 2, 2015

(54) SAFETY WINDOW FOR HURRICANE PROTECTION AND CRIME PREVENTION

(71) Applicant: CORCO AMERICA, INC, West Melbourne, FL (US)

(72) Inventor: Pan Jin Cho, Malabar, FL (US)

(73) Assignee: CORCO AMERICA, INC, West Melbourne, FL (US)

( * ) Notice: Subject to any disclaimer, the term of this patent is extended or adjusted under 35 U.S.C. 154(b) by 0 days.

(21) Appl. No.: 14/173,797

(22) Filed: Feb. 5, 2014

(65) Prior Publication Data

US 2014/0352239 A1 Dec. 4, 2014

(30) Foreign Application Priority Data

May 30, 2013 (CO) ..... 13-132434

(51) Int. Cl.

| | |
|---|---|
| ***E06B 3/26*** | (2006.01) |
| ***E06B 9/52*** | (2006.01) |
| ***E06B 9/02*** | (2006.01) |
| ***E06B 3/68*** | (2006.01) |
| ***E06B 5/11*** | (2006.01) |
| ***E06B 5/12*** | (2006.01) |
| *E06B 3/964* | (2006.01) |

(52) U.S. Cl.

CPC . *E06B 9/521* (2013.01); *E06B 9/02* (2013.01); *E06B 3/68* (2013.01); *E06B 3/9645* (2013.01); *E06B 5/11* (2013.01); *E06B 5/12* (2013.01)

(58) Field of Classification Search

CPC ..... E06B 5/11; E06B 5/12; E06B 3/9645
USPC ..... 52/202, 203, 204.5
See application file for complete search history.

(56) References Cited

U.S. PATENT DOCUMENTS

| | | | | | |
|---|---|---|---|---|---|
| 882,152 | A | | 3/1908 | Lang | |
| 1,351,940 | A | | 9/1920 | Blake | |
| 1,902,949 | A | * | 3/1933 | Condon | 49/57 |
| 2,576,260 | A | | 11/1951 | Metts | |
| 4,347,796 | A | * | 9/1982 | King et al. | 109/49.5 |
| 4,389,947 | A | * | 6/1983 | King et al. | 109/1 S |
| 4,599,836 | A | * | 7/1986 | Melcher | 52/202 |
| 5,187,867 | A | * | 2/1993 | Rawlings | 29/897.312 |
| 5,237,785 | A | * | 8/1993 | Lukes | 52/86 |
| 5,560,149 | A | | 10/1996 | Lafevre | |
| 5,575,321 | A | * | 11/1996 | Currier | 160/90 |

(Continued)

FOREIGN PATENT DOCUMENTS

| | | |
|---|---|---|
| KR | 200395048 | 9/2005 |
| KR | 200430381 | 11/2006 |

OTHER PUBLICATIONS

International Search Report and Written Opinion for PCT/US2014/038860, mailed Oct. 8, 2014.

*Primary Examiner* — Mark Wendell
*Assistant Examiner* — Keith Minter

(57) ABSTRACT

Disclosed is a safety window for hurricane protection and crime prevention. According to an embodiment of the inventive concept, the safety window for hurricane protection and crime prevention includes: an external frame which has a window shape and is installed in a window frame of a wall of a building; an internal frame which is coupled to the external frame; and a protection screen which comprises a plurality of holes to prevent an outsider from trespassing but allow air to pass therethrough, couples with the external and internal frames, and protects a window.

13 Claims, 11 Drawing Sheets

(56) References Cited

U.S. PATENT DOCUMENTS

| | | | | |
|---|---|---|---|---|
| 5,617,695 | A * | 4/1997 | Brimmer | 52/717.02 |
| 5,735,089 | A * | 4/1998 | Smith et al. | 52/202 |
| 5,737,874 | A * | 4/1998 | Sipos et al. | 49/67 |
| 5,783,264 | A * | 7/1998 | Howes | 428/13 |
| 5,853,828 | A | 12/1998 | Schimmelpenningh et al. | |
| 5,881,518 | A * | 3/1999 | Edwards et al. | 52/239 |
| 5,941,031 | A * | 8/1999 | Fullwood | 52/202 |
| 6,006,478 | A * | 12/1999 | Hubner et al. | 52/204.5 |
| 6,814,127 | B2 * | 11/2004 | Tagtow et al. | 160/31 |
| 7,775,002 | B2 * | 8/2010 | Puchniak | 52/202 |
| 8,006,442 | B2 * | 8/2011 | Cheng et al. | 52/144 |
| 8,225,562 | B2 | 7/2012 | Parker | |
| 2005/0210777 | A1 * | 9/2005 | Baughn et al. | 52/202 |
| 2008/0178540 | A1 * | 7/2008 | Salzer | 52/202 |
| 2008/0222978 | A1 * | 9/2008 | Salzer | 52/202 |
| 2008/0313979 | A1 * | 12/2008 | Holland et al. | 52/202 |
| 2009/0058295 | A1 * | 3/2009 | Auday et al. | 313/581 |
| 2009/0288353 | A1 * | 11/2009 | Barsby et al. | 52/202 |
| 2009/0316056 | A1 * | 12/2009 | Rosencwaig et al. | 348/836 |
| 2010/0132271 | A1 * | 6/2010 | Fernandez Fernandez | 52/79.9 |
| 2010/0170170 | A1 * | 7/2010 | Quick et al. | 52/202 |
| 2010/0197214 | A1 * | 8/2010 | Geremia et al. | 454/195 |
| 2011/0120031 | A1 * | 5/2011 | Scherba | 52/202 |
| 2011/0296774 | A1 * | 12/2011 | Tremaine et al. | 52/202 |
| 2012/0210862 | A1 * | 8/2012 | Coddens | 89/36.04 |
| 2012/0297706 | A1 | 11/2012 | Bourdon | |
| 2013/0042551 | A1 * | 2/2013 | Koutsoukos | 52/202 |
| 2013/0269271 | A1 * | 10/2013 | Webb | 52/202 |
| 2014/0000190 | A1 * | 1/2014 | Libby et al. | 52/204.61 |
| 2014/0041323 | A1 * | 2/2014 | Massey | 52/203 |
| 2014/0053479 | A1 * | 2/2014 | Valler et al. | 52/204.5 |
| 2014/0144090 | A1 * | 5/2014 | Rebman et al. | 52/203 |

* cited by examiner

SAFETY WINDOW FOR HURRICANE PROTECTION AND CRIME PREVENTION

CROSS-REFERENCE TO RELATED APPLICATIONS

This application claims the priority of Colombia Patent Application No. 13-132434, filed on 30 May 2013, in the Colombia Patent Office, the disclosure of which is incorporated herein by reference.

BACKGROUND

The inventive concept relates to a safety window for hurricane protection and crime prevention, and more particularly to a safety window for hurricane protection and crime prevention, which can prevent a window from damage due to a hurricane and prevent an outsider from trespassing through the window.

To protect life and property from losses due to the hurricane, a window or door is provided with a detachable hurricane protection shutter.

Such a hurricane protection shutter has a structure that plywood, plastic, metal or the like plate is fastened to and fully seals up the window or door, thereby completely blocking out light and air flow from an inside of a building.

That is, although the conventional hurricane protection shutter is effective to protect the window from the hurricane, it cannot give light and air to the inside of the building in a situation that the hurricane cuts off electricity, thereby making the inside of the building dark and causing poor ventilation.

SUMMARY OF THE INVENTION

The inventive concept provides a safety window for hurricane protection and crime prevention, which can give light and fresh air to an inside of a building through an open window as well as preventing a window from damage due to a hurricane and preventing an outsider from trespassing through the window.

According to an aspect of the inventive concept, there is provided a safety window for hurricane protection and crime prevention, the safety window including: an external frame which has a window shape and is installed in a window frame of a wall of a building; an internal frame which is coupled to the external frame; and a protection screen which includes a plurality of holes to prevent an outsider from trespassing but allow air to pass therethrough, couples with the external and internal frames, and protects a window.

The external frame may include a holding groove in which the internal frame is inserted and arranged; and a hooking projection which prevents the internal frame from separating from the holding groove, and the internal frame may include a supporting projection hooked to and supported on the hooking projection.

The external frame may include: a horizontal frame; a vertical frame connected to the horizontal frame; and a corner connection member inserted in the horizontal frame and the vertical frame and couples the horizontal frame and the vertical frame with each other.

The external frame may include: a partition member provided in the horizontal frame and the vertical frame to form a corner insertion hole in which the corner connection member can be inserted, and partitioning the holding groove; and a fastening screw penetrating the partition member and the protection screen and coupled to the internal frame.

The horizontal frame and the vertical frame may include through holes on outer walls thereof, so that the fastening screw can be fastened to the partition member via the through holes.

The internal frame may include: a plurality of horizontal clamping blocks arranged to face each other; a plurality of vertical clamping blocks arranged to face each other in between the plurality of horizontal clamping blocks and coupling the plurality of horizontal clamping blocks; and a plurality of bars arranged to intersect with each other to respectively couple the plurality of horizontal clamping blocks and the plurality of vertical clamping blocks.

One among the plural bars may include: a hollow core member; a bar member in which the core member is inserted and arranged; and an assembling screw which couples the core member and the bar member with the horizontal clamping block and the vertical clamping block.

One of the core member and the bar member may include a rotation-preventing groove, and the other one may include a rotation-preventing projection corresponding to the rotation-preventing groove and preventing rotation of the bar member.

The rotation-preventing groove and the rotation-preventing projection may be arranged at intervals of 90 degrees.

The protection screen may include a mesh latticed structure formed by on the plurality of lattice members.

The lattice member includes a stainless steel wire.

The stainless steel wire may have a diameter of 0.4 mm~0.9 mm, and the mesh latticed structure may provide a lattice hole having a diameter of 0.4 mm~1.0 mm.

The plurality of lattice members may include a guide wall which has a cross-section being gradually enlarged from a top thereof toward a bottom and offsets wind by guiding the wind applied to the top toward lateral sides.

The external frame may be made of aluminum and has a beam structure having a rectangular cross-section of which one side is opened, the internal frame may be made of aluminum and has a beam structure having a closed rectangular cross-section, and the protection screen may be first held by an alignment pin while surrounding at least three sides of the internal frame and then arranged between the external frame and the internal frame.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE INVENTION

Figure 1:
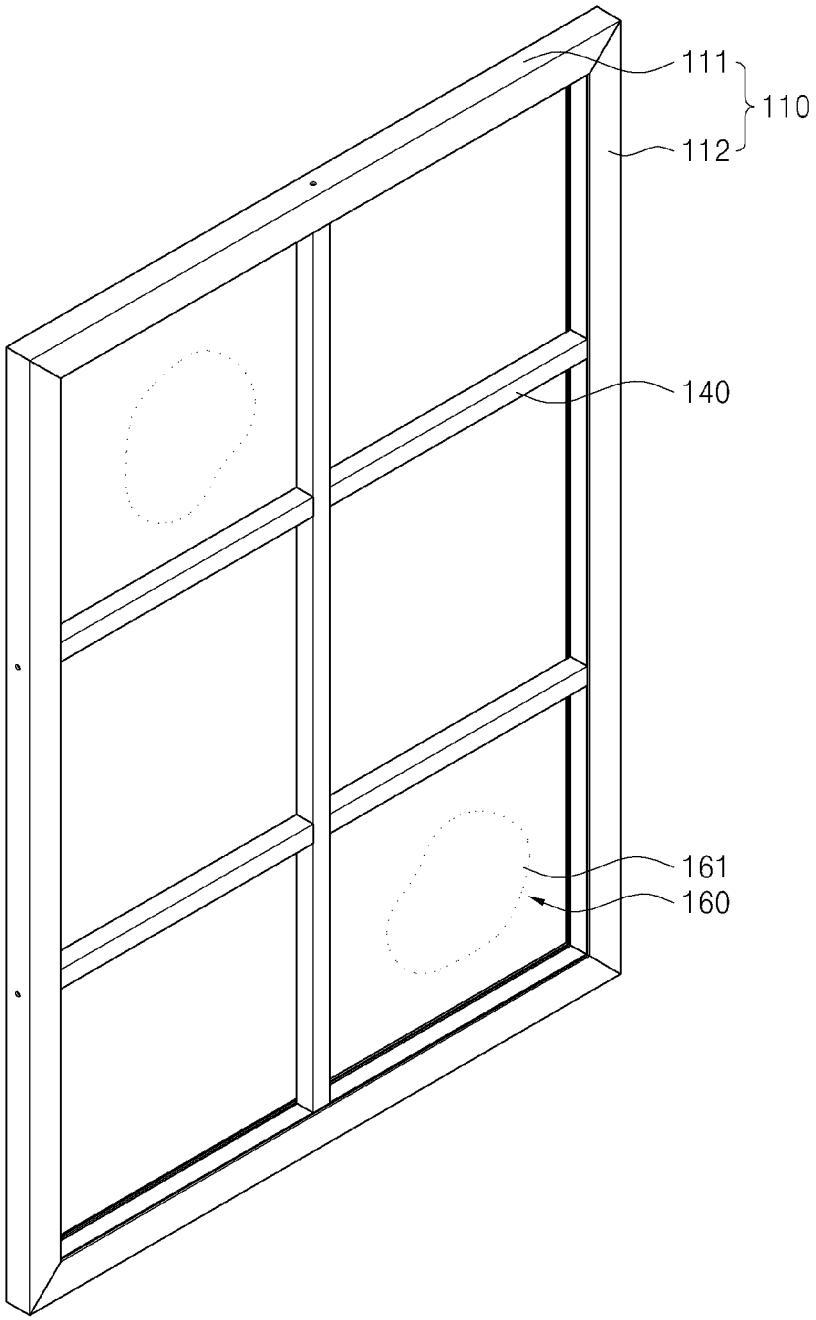
FIG. 1 is a perspective view of a safety window for hurricane protection and crime prevention according to an embodiment of the inventive concept.

The attached drawings for illustrating embodiments of the inventive concept are referred to in order to gain a sufficient understanding of the inventive concept and the merits thereof.

Hereinafter, the inventive concept will be described in detail by explaining embodiments of the inventive concept with reference to the attached drawings. Like reference numerals in the drawings denote like elements.

Figure 2:
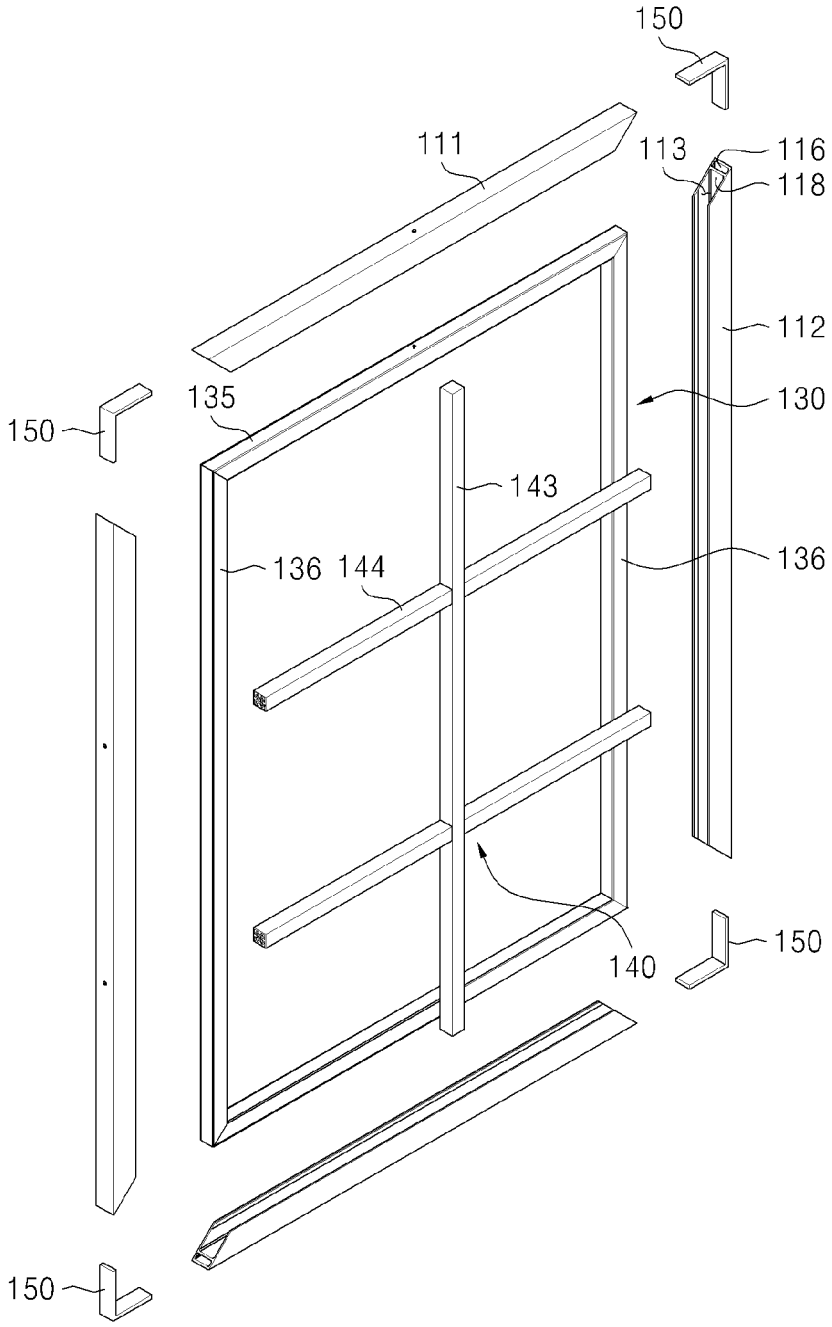
FIG. 2 is an exploded perspective view of a protection screen of FIG. 1.
Figure 3:
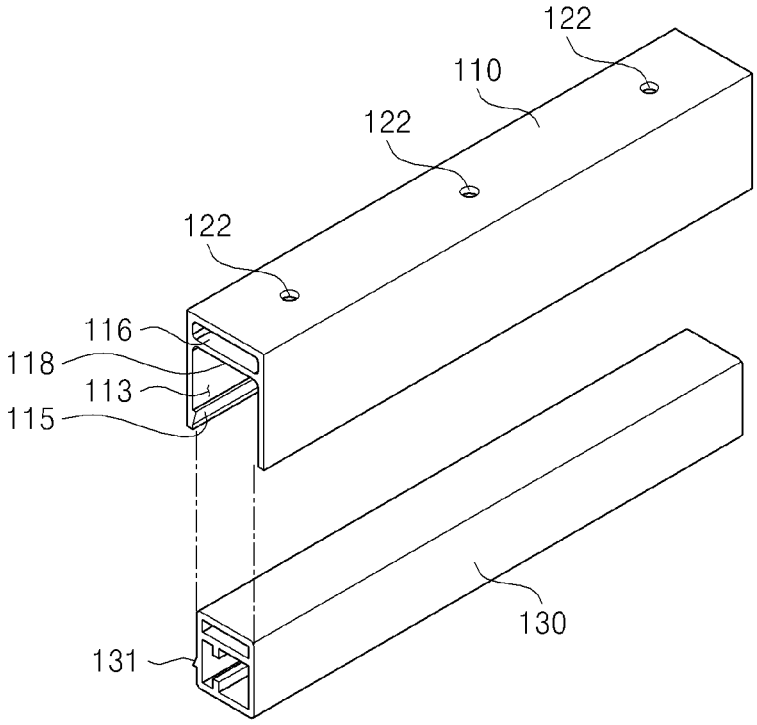
FIG. 3 is an exploded perspective view of an external frame and an internal frame of FIG. 1.
Figure 4:
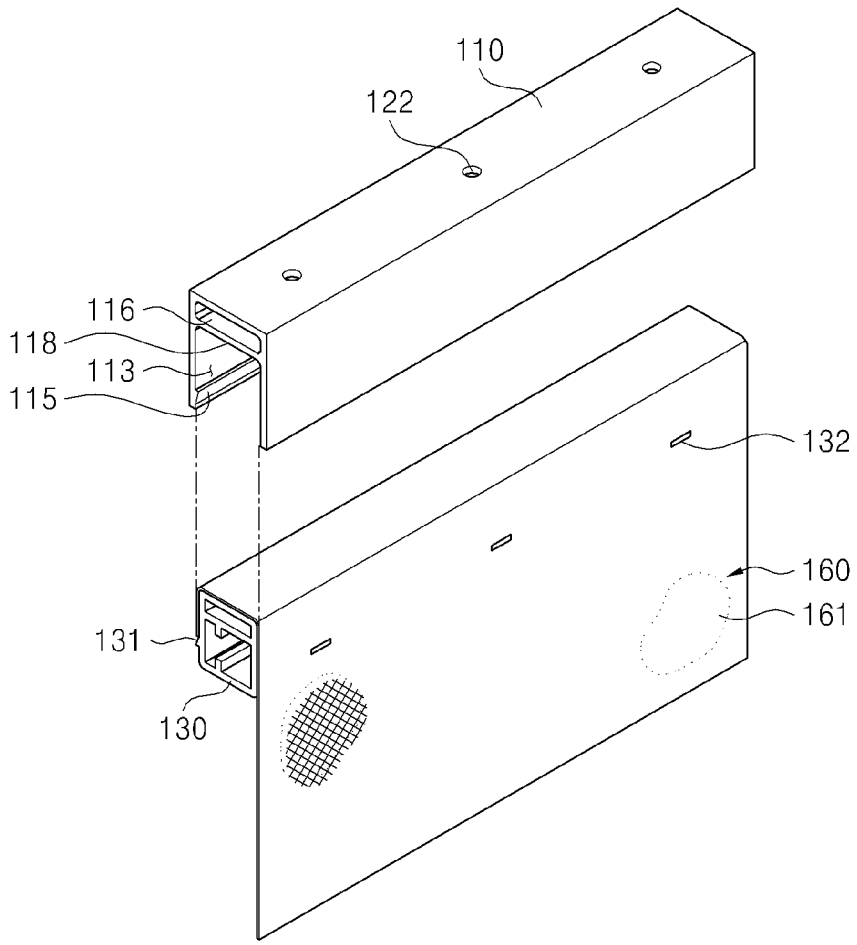
FIG. 4 is an exploded perspective view showing that the protection screen is wound on the internal frame of FIG. 3.
Figure 5:
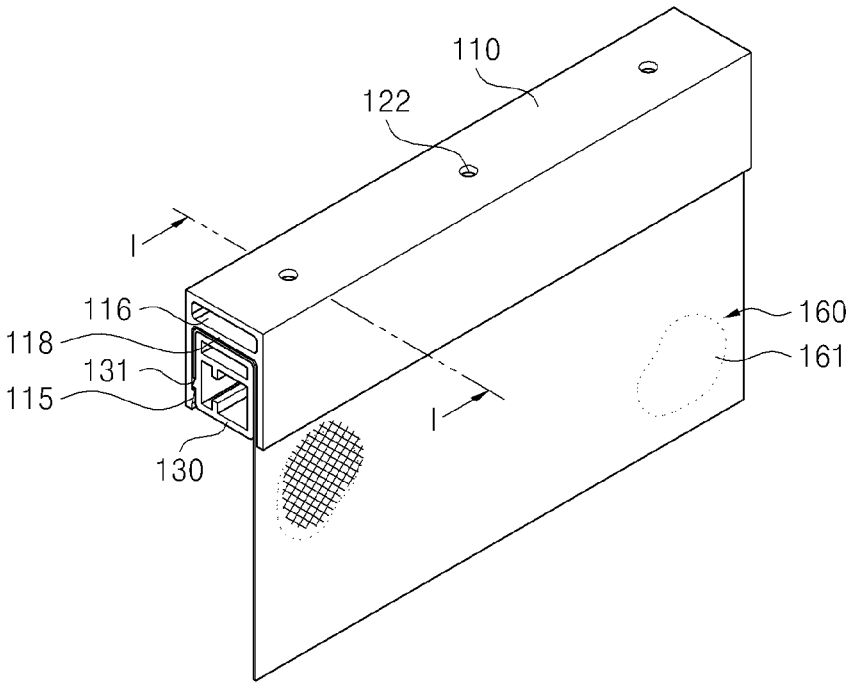
FIG. 5 is an assembled view of FIG. 4.

As shown in FIGS. 1 and 2, a safety window for hurricane protection and crime prevention according to an embodiment of the inventive concept includes an external frame 110 which has a window shape to be installed in a window frame of a wall of a building; an internal frame 130 which is inserted in and coupled to the external frame 110; and a protection screen 160 arranged to surround the internal frame 130 and fastened between the external frame 110 and the internal frame 130 to protect a window.

According to this embodiment, the safety window for hurricane protection and crime prevention can provide a simple assembling structure and a firm holding structure to the protection screen 160 as the protection screen 160 having a lattice structure for protecting a window is fitted to and held by the external frame 110 while surrounding the internal frame 130.

Also, the protection screen 160 is firmly held in between an outer wall of the internal frame 130 and an inner wall of the external frame 110, so that the window can be protected by the protection screen 160 in the state that the external frame 110 is installed in the window frame.

The protection screen 160 may include a stainless steel wire to be described later, which can relieve a shock of a strong wind such as hurricane by resisting the strong wind and reducing wind speed when the strong wind blows; protect the window from impact directly applied to the window by blocking an external object that may hit the window; and prevent an outsider from trespassing through the window. At the same time, the protection screen 160 can provide light and fresh air to an inside of a building while the window is being open.

Figure 6:
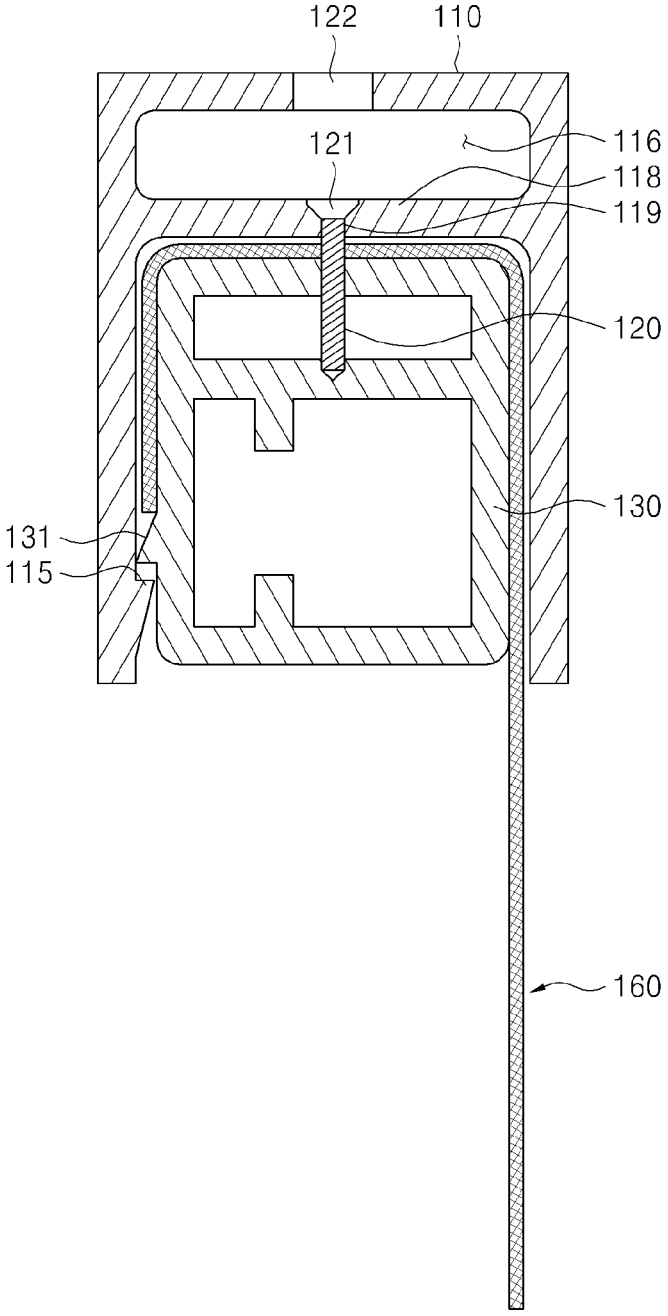
FIG. 6 is a cross-section view taken along line I-I of FIG. 5.
Figure 7:
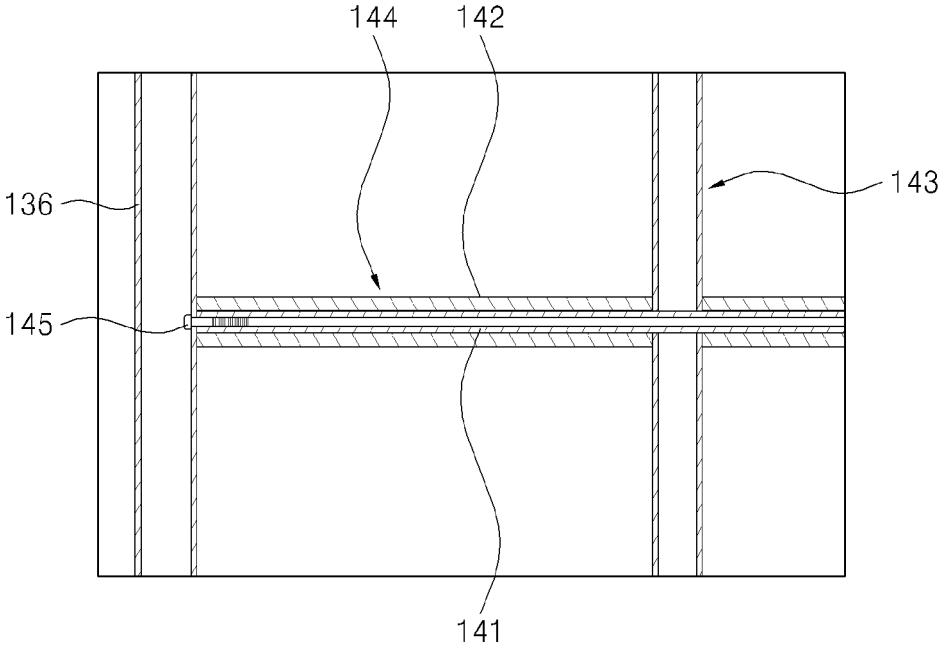
FIG. 7 is a cross-section view of bars of FIG. 1.
Figure 8:
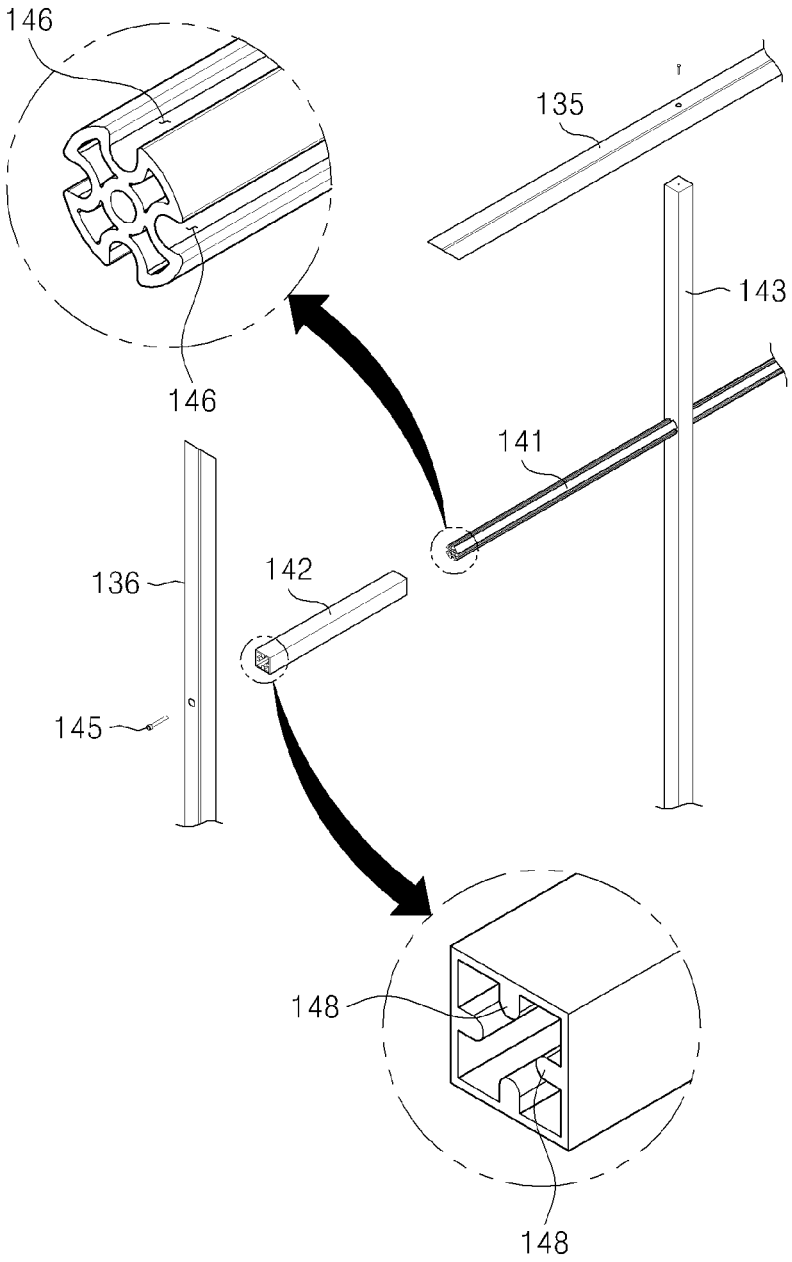
FIG. 8 is an exploded perspective view of the bars of FIG. 1.
Figure 9:
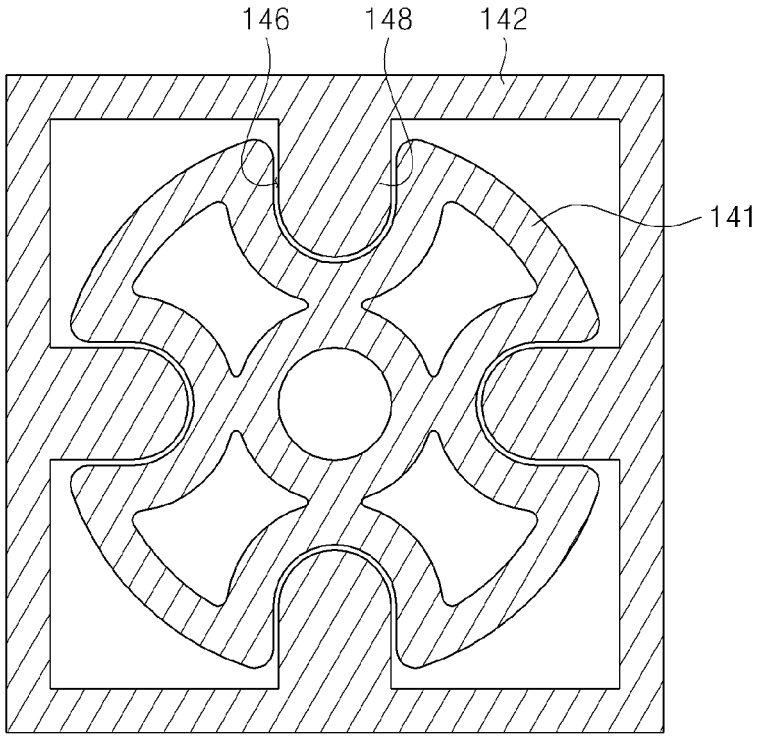
FIG. 9 is a cross-section view showing that a core member is coupled to a bar member in FIG. 8.

As shown in FIGS. 2 and 6, the assembling structure between the external frame 110 and the internal frame 130 firmly holding the protection screen 160 according to an exemplary embodiment can be shown in detail from the cross-section of the external frame 110 and the coupled state of the internal frame 130 to the external frame 110.

Below, the external frame 110, the internal frame 130 and the coupling structure therebetween, and the structure of the protection screen 160 will be described in detail with reference to FIGS. 2 to 6.

According to this exemplary embodiment, the external frame 110 includes a holding groove 113 in which the internal frame 130 is inserted and arranged, and a hooking projection 115 preventing the internal frame 130 from separating from the holding groove 113. Further, the internal frame 130 includes a supporting projection 131 corresponding to the hooking projection 115 and hooked by and supported on the hooking projection 115.

With this structure, an assembling process for the external frame 110 and the internal frame 130 starts from first fixing the protection screen 160 with an alignment pin 132 while three adjacent sides of the internal frame 130 are surrounded with the protection screen 160. At this time, the protection screen 160 surrounds the internal frame 130 so as to be adjacent to the supporting projection 131 of the internal frame 130.

Then, the internal frame 130 is fitted to the holding groove 113 of the external frame 110 so that the protection screen 160 can be arranged and held in between the external frame 110 and the internal frame 130. At this time, the internal frame 130 is fitted to the holding groove 113 from a lateral direction of the external frame to a width direction of the external frame 110 so as to prevent the supporting projection 131 from moving over the hooking projection 115.

As an alternative to the foregoing assembling method, if the internal frame 130 is placed under the external frame 110 and pressed toward and fitted to the holding groove 113, the supporting projection 131 may move over the hooking projection 115. In this case, the external frame 110 is achieved by an elastic body so that lower end portions thereof having the hooking projection 115 can be open when pressed by the internal frame 130. Thus, the external frame 110 can be restored from a transformed state to an original state when the internal frame 130 is fitted to the external frame 110.

To this end, according to this exemplary embodiment, the external frame 110 may be manufactured as an aluminum beam structure having a quadrangular cross-section, one side of which is opened, and the internal frame 130 may be manufactured as an aluminum beam structure having a closed quadrangular cross-section.

As an alternative to the foregoing embodiment, the external frame 110 and the internal frame 130 may be made of a composite material of synthetic plastic and carbon fiber or made of carbon steel so as to have durableness and high elasticity According to this embodiment, the external frame 110 may be manufactured to have the beam structure in a quadrangle shape corresponding to the window, which can have the following structure in order to simply and firmly the rectangular shape.

First, the external frame 110 according to an exemplary embodiment may include a horizontal frame 111, a vertical frame 112 connected to the horizontal frame 111, and a corner connection member 150 inserted in the horizontal frame 111 and the vertical frame 112 and coupling the horizontal frame 111 and the vertical frame 112 with each other. At this time, the corner connection member 150 has a rectangular structure so as to be arranged in a corner of a quadrangle formed by the horizontal frame 111 and the vertical frame 112 and couple the horizontal frame 111 and the vertical frame 112 with each other.

According to this embodiment, the external frame 110 is formed to insert therein the corner connection member 150 having the rectangular shape. That is, the external frame 110 may include a partition member 118 provided in the horizontal frame 111 and the vertical frame 112 and partitioning the holding groove 113, thereby forming a corner insertion hole 116 in which the corner connection member 150 can be inserted.

The partition member 118 limits an upper portion of the holding groove 113 to the size for firmly fitting the corner connection member 150, and provides screw holes 119 for fastening the internal frame 130 to the external frame 110.

As described above, the internal frame 130 is inserted and arranged in the holding groove 113 of the external frame 110 in the state that the protection screen 160 is wound on the internal frame 130, and firmly fastened by a fastening screw 120 to be prevented from separating and shaking. At this time, the screw hole 119 is used for fastening the fastening screw 120. The upper portion of the screw hole 119 is shaped to correspond to a head 121 of the fastening screw 120 so as to restrict and hold the head 121 of the fastening screw 120 fastened to the internal frame 130 via the partition member 118 and the protection screen 160.

Also, according to an embodiment, to easily insert the fastening screw 120 into the screw hole 119, the outer walls of the horizontal frame 111 and the vertical frame 112 may have a through hole 122 through which the fastening screw 120 passes to be fastened to the partition member 118.

The through hole 122 may be formed by drilling the external frame 110 along a the same center line as the center line of the screw hole 119. Then, the screw hole 119 can be formed by drilling the external frame 110 through the through hole 122 in the state that the through hole 122 is formed. The upper portion of the screw hole 119 shaped to correspond to the head 121 of the fastening screw 120 may be formed by changing a drill.

At this time, the screw hole (not shown) of the internal frame 140 communicating with the screw hole 119 may be formed by tapping so that the fastening screw 120 can be fastened thereto. The screw hole (not shown) of the internal frame 130 may be previously formed before the internal frame 130 is inserted into the holding groove 113 of the external frame 110. As an alternative to this exemplary embodiment, the screw hole (not shown) of the internal frame 140 and the screw hole 119 of the partition member 118 may be continuously formed by a drill inserted through the through hole 122 in the state that the internal frame 130 is inserted in the external frame 110.

According to an embodiment, the internal frame 130 is arranged in the holding groove 113 provided in an inner edge of the external frame 110, and therefore have a shape corresponding to the external frame 110. That is, the internal frame 130 may include a pair of horizontal clamping blocks 135 arranged to face each other, and a pair of vertical clamping blocks 136 arranged to face each other in between the pair of horizontal clamping blocks 135 and coupling the pair of horizontal clamping blocks 135.

Below, bars 140 installed in the internal frame 130 so as to support the protection screen 160 will be described with reference to FIGS. 2, 3 and 7 to 9.

According to an exemplary embodiment, the internal frame 130 may further include the bars 140 supporting the protection screen 160 in order to make the protection screen 160 withstand higher external shocks. The plurality of bars 140 intersecting each other may be arranged in the external frame 130 so that the pair of horizontal clamping blocks 135 and the pair of vertical clamping blocks 136 can be coupled to each other.

The plurality of bars 140 are arranged to have a simple crossed structure for supporting the back of the protection screen 160. If impact higher than allowable strength is applied to the protection screen 160, the bars 140 can protect the protection screen 160 from damage. In this embodiment, a direction from which the strong wind is blowing will be defined as the front of the protection screen 160.

Also, the crossed bars 140 widely support the back of the protection screen 160 and thus restrict deformation of the protection screen 160, thereby relieving rupture due to accumulation of deformation and fatigue. Also, it is prevent an invader from cutting the protection screen 160 and trespassing into a residential space.

To this end, the bars 140 assembled to the quadrangular internal frame 130 to give a firm holding structure according to an exemplary embodiment may include a plurality of members. That is, a horizontal bar 144 corresponding to one among the plural bars 140 may include a hollow core member 141, a bar member 142 in which the core member 141 is inserted and arranged, and an assembling screw 145 coupling the core member 141 and the bar member 142 to the horizontal clamping blocks 135 and the vertical clamping blocks 136.

One of the core member 141 and the bar member 142 is provided with a rotation-preventing groove 146, and the other one is provided with a rotation-preventing projection 148 corresponding to the rotation-preventing groove 146 and preventing the bar member 142 from rotation. According to this exemplary embodiment, the core member 141 is formed with the rotation-preventing groove 146, and the bar member 142 is formed with the rotation-preventing projection 148 corresponding to this. At this time, the rotation-preventing groove 146 and the rotation-preventing projection 148 may be arranged at intervals of 90 degrees.

Among the bars 140 according to the exemplary embodiment, a vertical bar 143 is arranged as being penetrated by the core member 141 that constitutes a horizontal bar 144. At this time, the bar member 142 is put on and coupled to the core member 141. The bar member 142 has a length corresponding to a space between the vertical bars 143 with regard to both the vertical clamping blocks 136. In the state that the bar member 142 is put on the core member 141, the core member 141 is coupled to the assembling screw 145 inserted in the vertical clamping blocks 136 and fastened to both the vertical clamping blocks 136.

The protection screen 160 arranged in front of the bars 140 may be made of a material that is durable and not easily deformed. That is, as described above, the protection screen 160 may be made of a stainless steel wire and have a mesh latticed structure.

Such a mesh latticed structure of the protection screen 160 resists the strong wind blowing toward the window and changes the strong wind into a weak wind. The mesh latticed structure may have a smaller size than the scale of plotting paper in order to damp shock energy to the window. That is, the strong wind hits the window in the state that its kinetic energy is weakened as the wind speed is decreased by flow resistance of the latticed structure while passing through the latticed structure of the protection screen 160.

As described above, the protection screen 160 is manufactured to have the mesh latticed structure as the plurality of lattice members 161 are arranged in horizontal and vertical directions. At this time, the lattice member 161 may be made of the stainless steel wire among various materials, and the stainless steel wire may have a diameter of 0.4 mm~0.9 mm. Further, the mesh latticed structure may provide a lattice hole having a diameter of 0.4 mm~1.0 mm to relieve the strong wind. Such a dense latticed structure with the lattice hole having approximately the same diameter as the stainless steel wire can provide sufficiently effective flow resistance with respect to the strong wind. Also, the protection screen 160 may provide light and fresh air to the inside of the building through the lattice hole when the window is open.

According to an exemplary embodiment, the lattice member 161 may be made of not only the stainless steel wire but also a high molecular compound capable of providing high stiffness like aramid fiber.

Meanwhile, the lattice member 161 of the protection screen 160 according to an exemplary embodiment may further include a guide wall 165 that has a cross-section being gradually enlarged from a top thereof toward a bottom and offsets wind by guiding the wind applied to the top toward lateral sides.

The guide wall 165 is rounded to make the cross-section of the lattice member 161 be gradually enlarged, so that the strong wind applied to the plurality of lattice members 161 can be partially guided in opposite directions and thus the strong winds guided in the directions opposite to each other can be offset.

Figure 10:
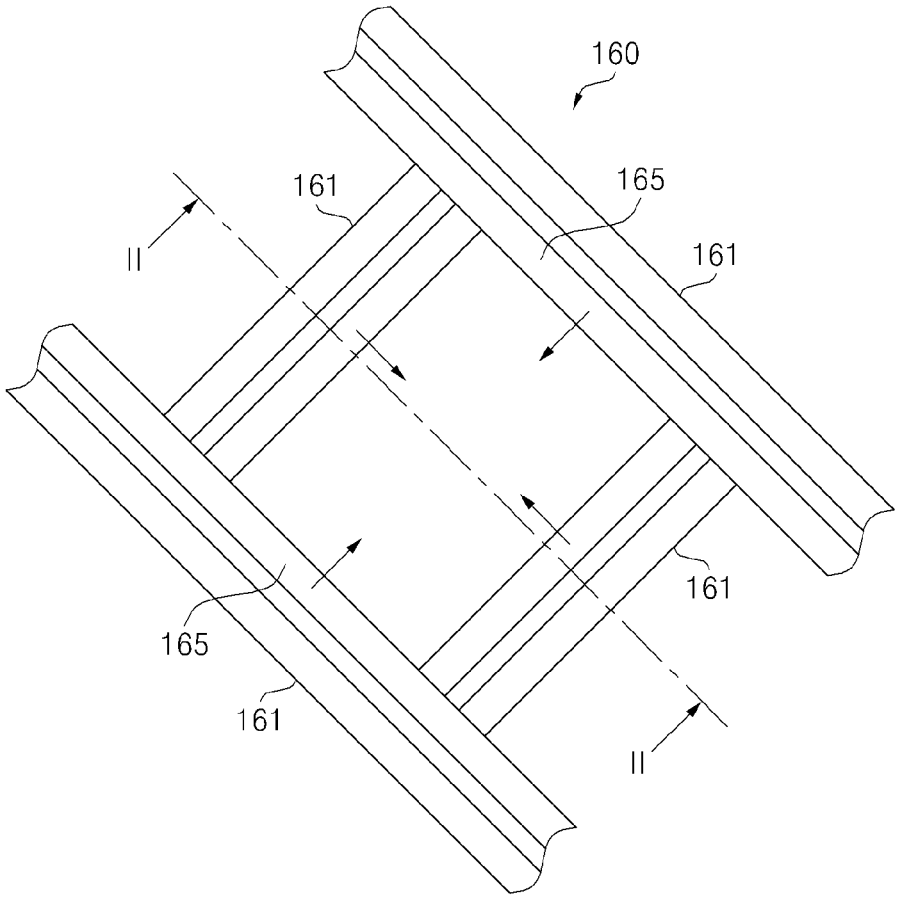
FIG. 10 is an enlarged front view of a lattice member of the protection screen of FIG. 1.
Figure 11:
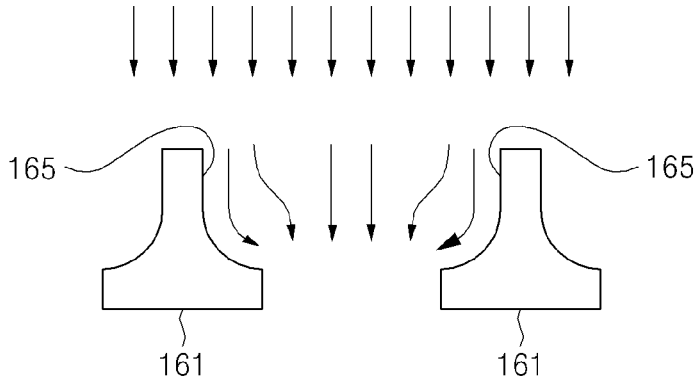
FIG. 11 is a cross-section view of the lattice member of FIG. 10, taken along line II-II.

FIG. 10 shows an enlarged view of the lattice member 161 of the protection screen 160, and FIG. 11 shows a cross-section view of the plurality of stainless steel wire. In FIGS. 10 and 11, it is illustrated that the strong wind applied to the protection screen 160 is guided along the guide wall 165 and its kinetic energy is offset within one lattice.

The arrows shown in FIGS. 10 and 11 indicate the flow directions of the strong window. According to an exemplary embodiment, the strong wind flows toward the center of the lattice hole by the rounded structure corresponding to the guide wall 165 of the lattice member 161. Therefore, the strong winds blowing in the opposite directions are offset while running against each other, and the strong wind going straightly also meets the flow resistance.

Such a cross-section structure of the lattice member 161 may be achieved by drawing or pressing out the stainless steel wire to have the guide wall 165. Alternatively, the stainless steel wire may be coated with another material to have the foregoing cross-section of the lattice member 161.

According to the present inventive concept, there is provided the safety window for hurricane protection and crime prevention, in which the protection screen with the lattice structure for protecting the window is fitted to and held by the external frame while surrounding the internal frame, so that the window can be protected from hurricane, an outsider can be prevented from trespassing through the window, and light and fresh air can be supplied to the inside of the building by opening the window.

While the inventive concept has been particularly shown and described with reference to exemplary embodiments thereof, it will be understood that various changes in form and details may be made therein without departing from the spirit and scope of the following claims.

What is claimed is:

1. A safety window for hurricane protection and crime prevention, the safety window comprising:

an external frame which has a window shape and is installed in a window frame of a wall of a building;

an internal frame which is coupled to the external frame;

a protection screen which comprises a plurality of holes to prevent an outsider from trespassing but allow air to pass therethrough, couples with the external and internal frames, and protects a window; and wherein the internal frame comprises:

a plurality of horizontal clamping blocks arranged to face each other;

a plurality of vertical clamping blocks arranged to face each other in between the plurality of horizontal clamping blocks and coupling the plurality of horizontal clamping blocks; and a plurality of bars arranged to intersect with each other to respectively couple the plurality of horizontal clamping blocks and the plurality of vertical clamping blocks.

2. The safety window according to claim 1, wherein the external frame comprises a holding groove in which the internal frame is inserted and arranged; and a hooking projection which prevents the internal frame from separating from the holding groove and the internal frame comprises a supporting projection hooked to and supported on the hooking projection.

3. The safety window according to claim 2, wherein the external frame comprises:

a horizontal frame;

a vertical frame connected to the horizontal frame; and a corner connection member inserted in the horizontal frame and the vertical frame and couples the horizontal frame and the vertical frame with each other.

4. The safety window according to claim 3, wherein the external frame comprises:

a partition member provided in the horizontal frame and the vertical frame to form a corner insertion hole in which the corner connection member can be inserted, and partitioning the holding groove; and a fastening screw penetrating the partition member and the protection screen and coupled to the internal frame.

5. The safety window according to claim 4, wherein the horizontal frame and the vertical frame comprises through holes on outer walls thereof, so that the fastening screw can be fastened to the partition member via the through holes.

6. The safety window according to claim 1, wherein one among the plural bars comprises:

a hollow core member;

a bar member in which the core member is inserted and arranged; and an assembling screw which couples the core member and the bar member with the horizontal clamping block and the vertical clamping block.

7. The safety window according to claim 6, wherein one of the core member and the bar member comprises a rotation-preventing groove, and the other one comprises a rotation-preventing projection corresponding to the rotation-preventing groove and preventing rotation of the bar member.

8. The safety window according to claim 7, wherein the rotation-preventing groove and the rotation-preventing projection are arranged at intervals of 90 degrees.

9. The safety window according to claim 1, wherein the protection screen comprises a mesh latticed structure formed by on the plurality of lattice members.

10. The safety window according to claim 9, wherein the lattice member comprises a stainless steel wire.

11. The safety window according to claim 10, wherein the stainless steel wire has a diameter of 0.4 mm~0.9 mm, and the mesh latticed structure provides a lattice hole having a diameter of 0.4 mm~0.9 mm.

12. The safety window according to claim 9, wherein the plurality of lattice members comprises a guide wall which has a cross-section being gradually enlarged from a top thereof toward a bottom and offsets wind by guiding the wind applied to the top toward lateral sides.

13. The safety window according to claim 1, wherein the external frame is made of aluminum and has a beam structure having a rectangular cross-section, one side of which is opened, the internal frame is made of aluminum and has a beam structure having a closed rectangular cross-section, and the protection screen is first held by an alignment pin while surrounding at least three sides of the internal frame and then arranged between the external frame and the internal frame.

* * * * *